US006385875B1

(12) United States Patent
Santorsola

(10) Patent No.: US 6,385,875 B1
(45) Date of Patent: May 14, 2002

(54) DISPLAY

(76) Inventor: Alan J. Santorsola, 6002 Beacon Ave. S., Seattle, WA (US) 98108

( * ) Notice: Subject to any disclaimer, the term of this patent is extended or adjusted under 35 U.S.C. 154(b) by 0 days.

(21) Appl. No.: 09/524,357

(22) Filed: Mar. 14, 2000

Related U.S. Application Data

(63) Continuation-in-part of application No. 09/141,235, filed on Aug. 27, 1998, now abandoned.

(51) Int. Cl.[7] ..... G09F 1/00

(52) U.S. Cl. ..... 40/124.191; 116/316; 446/149; 40/495

(58) Field of Search ..... 40/124.01, 124.191, 40/113, 115, 445, 492, 495, 710, 777; 116/309, 316, 318; 434/78, 104, 368, 402, 404; 446/147, 149, 151, 152

(56) References Cited

U.S. PATENT DOCUMENTS 1,410,130 A * 3/1922 Sinclair ..... 40/710
2,071,338 A * 2/1937 Henze et al. ..... 40/495 X
2,755,577 A * 7/1956 Greensfelder ..... 40/495 X
2,842,882 A * 7/1958 Greene et al. ..... 40/710
3,248,809 A * 5/1966 Stifano, Jr. ..... 40/491 X
3,431,667 A * 3/1969 Woods ..... 40/710
5,669,165 A * 9/1997 Santorsola ..... 40/124.191

* cited by examiner

*Primary Examiner*—Brian K. Green
(74) *Attorney, Agent, or Firm*—Robert W. Jenny

(57) ABSTRACT

Two plastic film transparencies are rotatably attached side-by-side by engagement of film portions on one transparency with at least one incision on the other. There are images on each transparency and the rotatable attachment allows relative rotation of the transparencies to overlay the images on the transparencies. The images are cooperative so that overlaid images provide cooperative images. The rotatable attachment is accomplished by film portions on one transparency engaging an incision or incisions on the other. In some embodiments of the subject invention at least one of the transparencies is essentially circular. In all embodiments of the invention the relative rotation of the transparencies is in a range of 10° to 360°.

8 Claims, 3 Drawing Sheets

DISPLAY

This Application is a Continuation-In-Part of application Ser. No. 09/141,235, Filed Aug. 27, 1998 now abandonded.

TECHNICAL FIELD

The present invention relates to a variation of the invention disclosed and claimed in my U.S. Pat. No. 5,669,165, granted Sep. 23, 1997 and entitled "Picture Card". More particularly, it relates to a display formed of two transparencies that are connected together in a way permitting rotation of one of the transparencies relative to the other transparency for the purpose of moving cooperative images on the transparencies into and out of registry with each other.

BACKGROUND OF THE INVENTION

The background of the invention set forth in my aforementioned U.S. Pat. No. 5,669,165 is hereby incorporated herein by this specific reference. An object of the present invention is to provide displays that in concept are like the displays disclosed in my U.S. Pat. No. 5,669,165, but which are characterized by new and unique structure for connecting the transparencies together and/or supporting the transparencies for rotation, one relative to another.

U.S. Pat. No. 1,410,130, issued to A. N. Sinclair, is prior art relevant to the subject application since it covers transparencies movably attached to a transparency with images on all the transparencies. However, the images are not cooperative and while there can be minor relative motion between the transparencies, the transparencies are such that no useful purpose can be served by such relative motion.

DISCLOSURE OF THE INVENTION

Displays of the present invention are basically characterized by a first plastic film transparency having at least one first image on it and a second plastic film transparency having at least one second image on it, said images being cooperative with cooperation produced when the images overlay each other. The film transparencies are rotatably attached to allow such overlay and produce the cooperation. The first and second transparencies are positioned side-by-side. In one embodiment of the invention the first transparency has a circular row of circumferentially spaced apart incisions in it. The second transparency includes film portions that project through the incisions in the first transparency and connect the transparencies together, allowing at least some rotation, one relative to the other. Owing to this construction, one transparency can be rotated relative to the other to bring the images to be overlaid so that the two overlaid images provide a predetermined cooperative image. In this embodiment the first transparency may not be circular.

In a second embodiment of the invention, the film portions of the second transparency that project through the incisions in the first transparency are peripheral portions of the second transparency.

In another embodiment of the invention, the incisions in the first transparency form radially outwardly directed flaps and the peripheral portions of the second transparency extend radially outwardly through and beyond the incisions along side the flaps.

In yet another embodiment of the invention, the second transparency may include incisions that form radially directed flaps constituting the film portions of the second transparency that project through the incisions in the first transparency. These flaps are circumferentially shorter than the incisions in the first transparency, so that the transparencies are rotatably attached and at least some related rotation of the transparencies is permitted.

In all of the embodiments of the subject invention at least one of the transparencies is preferably essentially circular and relative rotation between the transparencies is in a range of 10° to 360°. For purposes of this disclosure, the term "essentially circular" means circular with tabs on the periphery of the circle, circular with portions removed from the periphery of the circle and oval shaped.

These and other advantages, and objects of the present invention will become apparent from the following detailed description of the best mode, when read together with the drawings, and the claims, which are all incorporated herein as part of the disclosure of the invention.

BRIEF DESCRIPTION OF THE DRAWINGS

Like reference numerals are used to indicate like parts throughout the various figures of the drawing, and.

BEST MODE FOR CARRYING OUT THE INVENTION

Figure 1:
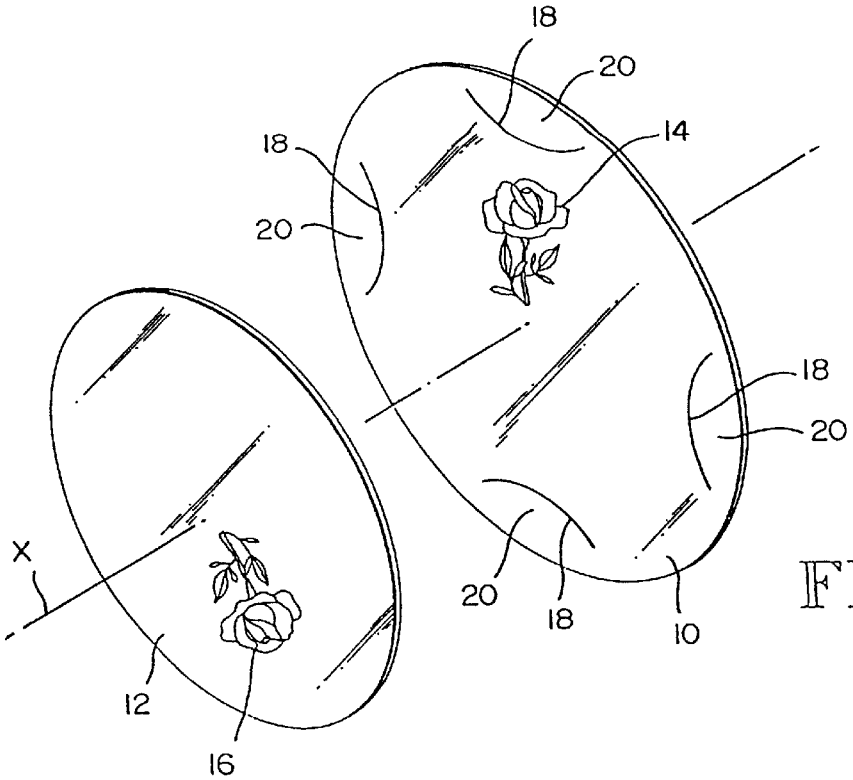
FIG. 1 is an exploded pictorial view of a first embodiment of the invention.
Figure 2:
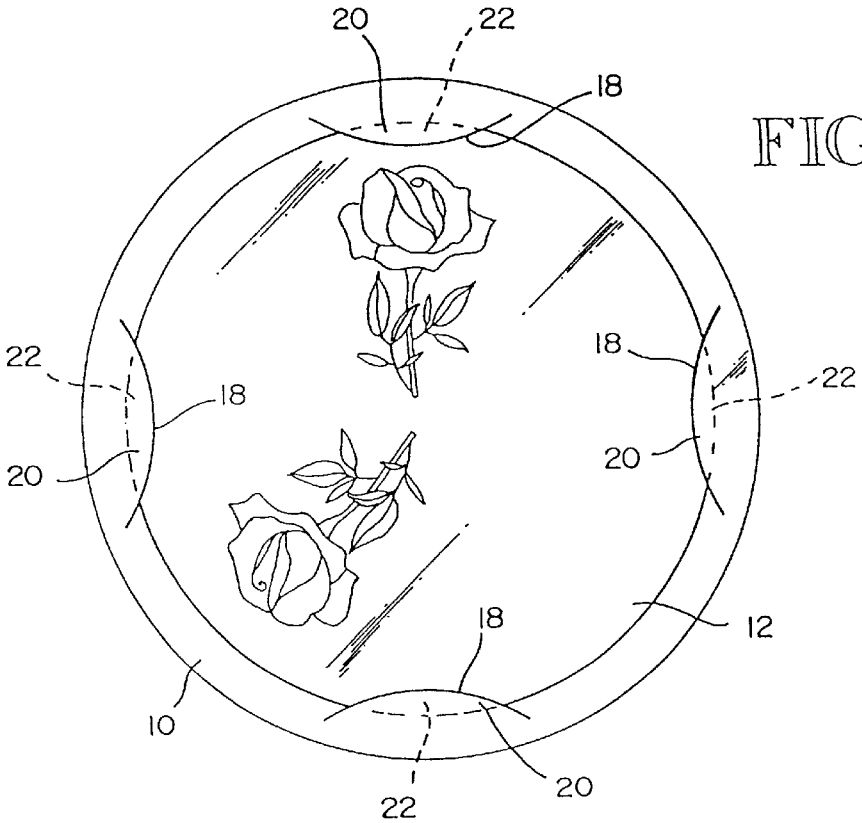
FIG. 2 is a side elevational view of the first embodiment of the invention, looking towards the second transparency side of the display and showing the second transparency connected to the first transparency.

FIGS. 1 and 2 show a first embodiment of the invention. It comprises a first plastic film transparency 10 and a second, smaller plastic film transparency 12. Herein, the term "transparency" means "a transparent object", much like a photographic slide. The term "transparent" means "capable of transmitting light so that objects or images can be seen." "Plastic film" is used herein to mean a material much like the material from which photographic negatives and slides or other positives are made, but perhaps a little thicker and stiffer, e.g. LEXAN®. The image may be printed on the plastic film, using known printing techniques.

As previously stated, the second transparency 12 is slightly smaller in size than the first transparency 10, which may not be circular. First and second images 14, 16 are imprinted on the transparencies 10, 12. The design of the images 14, 16 can vary. For example, first transparency 10 and second transparency 12 can have identical images 14, 16 printed thereon, each with a full range of colors. By way of another example, each transparency 10, 12 can include partial images that when overlaid produce a desired cooperative image. The images 14, 16 may be partial in terms of the image itself and/or the colors that make up the cooperative image. In other words, image 14 may include only portions of a full image and/or portions of the colors of the full image, with image 16 including the remaining portion of the full image and/or colors of the full image.

Figure 3:
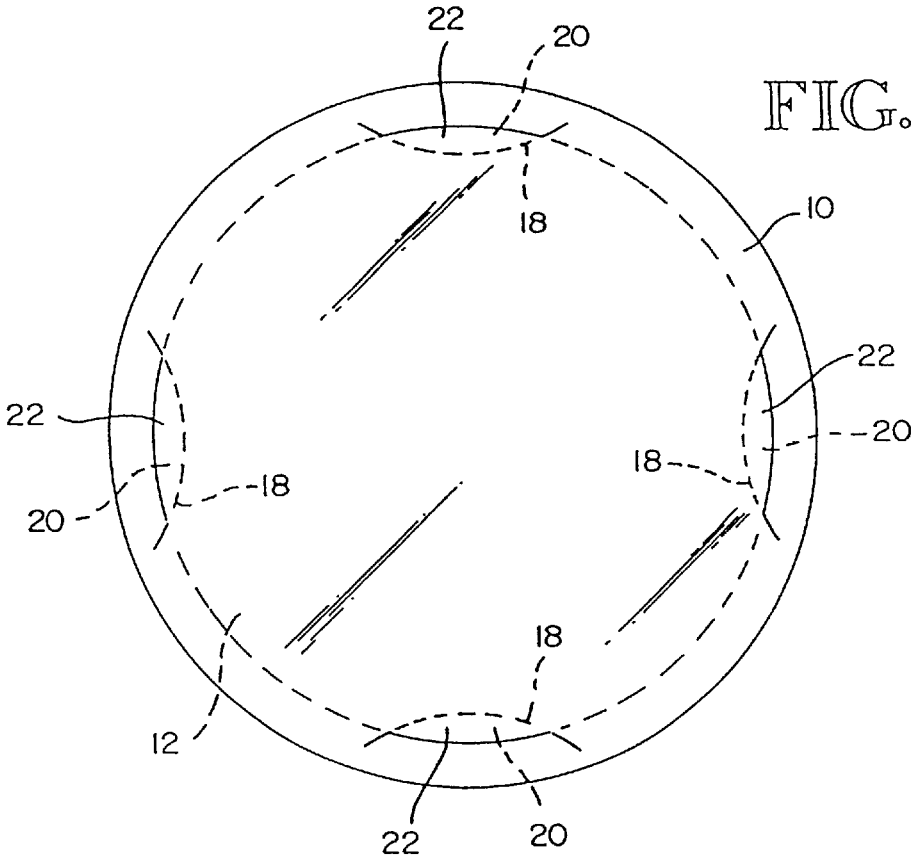
FIG. 3 is a view like FIG. 2, but looking towards the first transparency side of the display.

Regardless of the makeup of the images 14, 16, the transparencies 10, 12 are rotatably attached in a manner that will now be described. The larger transparency 10 is formed to include a circular row of arcuate incisions 18, spaced apart around its circumference. The incisions 18 form radially inwardly directed flaps 20. As best shown by FIG. 2, the smaller transparency 12 has film portions 22 that fit through the incisions 18 and project radially outwardly beyond the incisions 18, along side of the flaps 20. In the embodiment of FIGS. 1 and 2, the film portions of the smaller transparency 12 that project through the incisions 18 in the first transparency 10 are peripheral portions 22 of the second transparency 12. As will be apparent from FIGS. 1–3, the engagement of the peripheral portions 22 of the smaller transparency 12 with the incisions 18 and flaps 20 of the larger transparency 10 connects the smaller transparency 12 to the larger transparency 10 but in a way that allows the smaller transparency 12 to be rotated relative to the larger transparency 10 about axis x. As will be apparent, this construction allows a full three hundred and sixty degrees (360°) of relative rotation.

Figure 4:
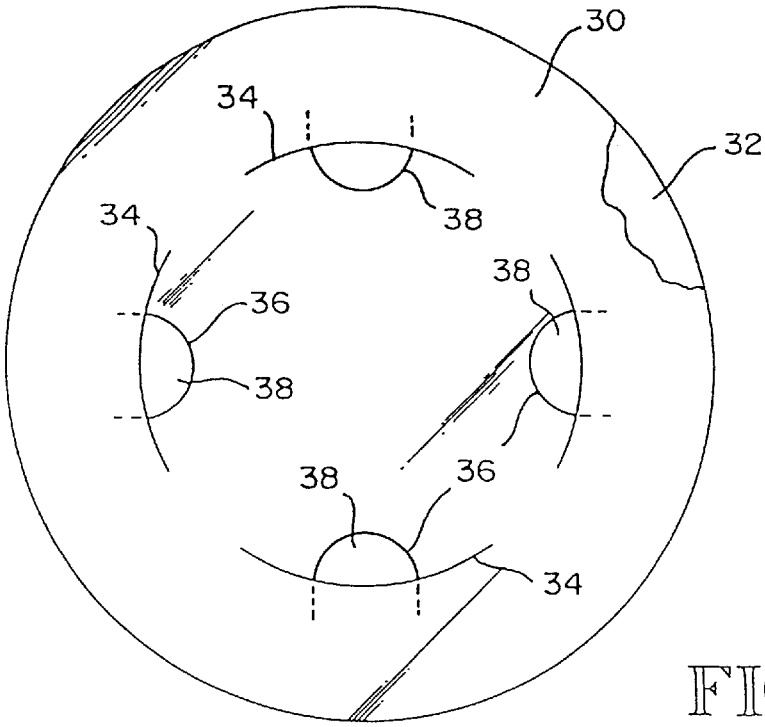
FIG. 4 is a side view of a third embodiment of the invention.

FIG. 4 shows a second embodiment of the invention. It includes two transparencies 30, 32, having the characteristics of the transparencies described above. However, transparencies 30, 32 may be either equal or unequal in size and transparency 32 may not be circular. In this embodiment, the transparency 30 is provided with a circular row of incisions 34 that constitute what might be referred to as "tracks." Transparency 32 includes incisions 36 that form flaps 38. In FIG. 4, transparency 30 is on the top and transparency 32 is on the bottom. The flaps 38 project through the incisions 34. As clearly illustrated, flaps 38 are circumferentially narrower than the incisions or "tracks" 34. As a result, a limited amount of rotation is permitted between transparencies 30 and 32. Rotation may be for the purpose of overlaying images, as discussed above, or may be for some other purpose. The incisions 36 may be formed to create outwardly projecting flaps. Also, incisions 34 may be made to be outwardly concave and inwardly convex.

Figure 5:
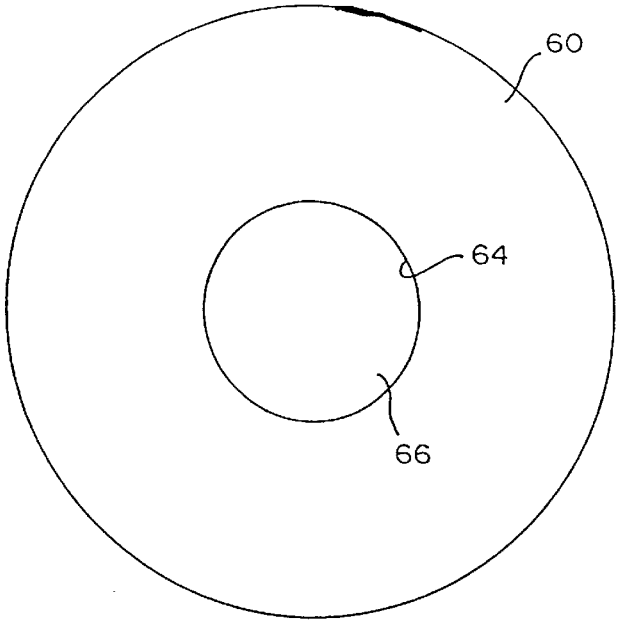
FIG. 5 is a side view of a first transparency that is a part of a fifth embodiment of the invention.
Figure 6:
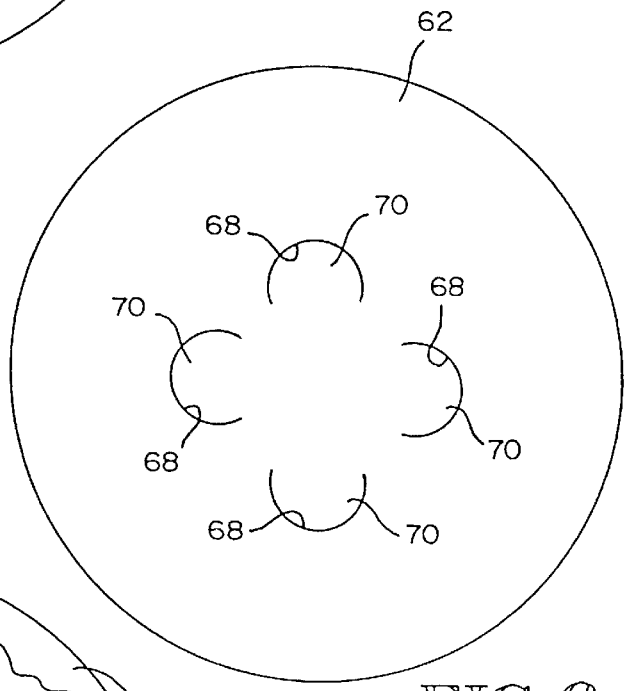
FIG. 6 is a side view of a second transparency that is a part of the fifth embodiment of the invention.
Figure 7:
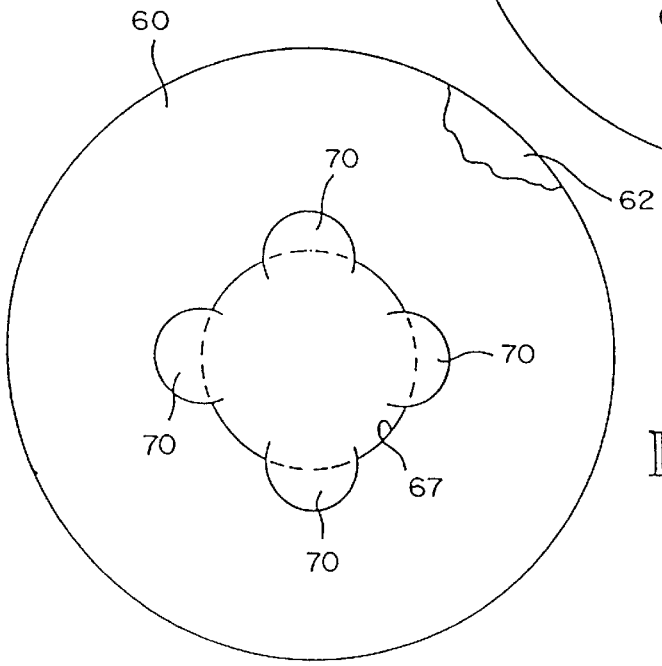
FIG. 7 is a view like FIGS. 7 and 8, but showing the two transparencies connected together.

FIGS. 5, 6 and 7 show a fourth embodiment of the invention. It comprises a first transparency 60 and a second transparency 62. The transparencies 60, 62 are both shown to be circular and are shown to be equal in diameter. However, the diameters can be unequal. Also, the shape of the transparencies 60, 62 can be different. For example, one of the transparencies 60, 62 could be circular and the other square, both could be square, or one could be oval and the other rectangular.

Referring to FIG. 5, transparency 60 is shown to include an incision 64 that is circular and forms a hole 66 in the center of the transparency 60. As shown by FIG. 6, transparency 62 may include incisions 68 forming flaps 70 in the transparency 62. The bases of the flaps 70 lie on a circle that is slightly smaller in diameter than the circle formed by incision 64 in transparency 60.

FIG. 7 shows transparency 60 placed forwardly adjacent transparency 62. It further shows the flaps 70 repositioned to be forwardly of the film 60. This is done by bending the flaps 70 so that they will pass through the opening formed by incision 64. Once through the opening 64, the flaps 70 are released, allowing them to move into positions in which they overlap the film 60. As will be apparent, the engagement of the flaps 70 with the film material bordering the hole 67 rotatably attaches transparencies 60, 62, one relative to the other. As in the earlier embodiments, the film 60, 62 maybe provided with images or partial images that when overlaid will cooperate to produce a cooperative image.

In all of the embodiments of the subject invention at least one of the transparencies is preferably essentially circular and relative rotation between the transparencies is in a range of 10° to 360°.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine and equivalents and reversal of parts.

What is claimed is:

1. A display, comprising:

a first plastic film transparency having at least one first image on it;

a second plastic film transparency having at least one second image on it;

said first and second transparencies being positioned side-by-side;

said first transparency having at least three incisions in it;

said second transparency including film portions that engage said at least three incisions in said first transparency to rotatably attach said transparencies to allow rotation one relative to the other in a range of 10° to 360° so that one transparency is rotatable relative to the other to overlay said images so that said first and second images provide a cooperative image.

2. A display according to claim 1 in which at least one of said transparencies is essentially circular.

3. A display, comprising:

a first plastic film transparency having at least one first image on it;

a second plastic film transparency having at least one second image on it;

said first and second transparencies being positioned side-by-side;

said first transparency having a circular row of circumferentially spaced apart incisions in it;

said second transparency including film portions that project through the incisions in said first transparency to rotatably attach the transparencies to allow at least some rotation, one relative to the other so that one transparency is rotable in a range of 10° to 360° relative to the other to overlay the images so that the first and second images provide a cooperative image.

4. A display according to claim 3, wherein the film portions of the second transparency that project through the incisions in the first transparency are peripheral portions of the second transparency.

5. A display according to claim 4, wherein the incisions in the first transparency form radially inwardly directed flaps, and the peripheral portions of the second transparency extend through and radially outwardly from the incisions, along side the flaps.

6. A display according to claim 3 in which at least one of said transparencies is essentially circular.

7. A display comprising:

a first plastic film transparency having at least one first image on it;

a second plastic film transparency having at least one second image on it;

said first and second transparencies being positioned side-by-side;

said first transparency having one incision in it, said one incision forming a circular hole;

said second transparency including film portions that engage film material bordering said circular hole in said first transparency to rotatably attach said transparencies to allow 360° rotation one relative to the other so that one transparency is rotatable relative to the other to overlay said images so that said first and second images provide a cooperative image.

8. A display according to claim 7 in which at least one of said transparencies is essentially circular.

* * * * *